US008794019B2

(12) United States Patent
Kuehl et al.

(10) Patent No.: US 8,794,019 B2
(45) Date of Patent: Aug. 5, 2014

(54) VARIABLE POSITION AIR DAMPER FOR A REFRIGERATOR

(75) Inventors: Steven John Kuehl, Stevensville, MI (US); James Charles Leslie Guarino, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 223 days.

(21) Appl. No.: 13/047,923

(22) Filed: Mar. 15, 2011

(65) Prior Publication Data

US 2011/0162393 A1 Jul. 7, 2011

Related U.S. Application Data

(62) Division of application No. 11/780,179, filed on Jul. 19, 2007, now Pat. No. 7,926,298.

(51) Int. Cl.
*F25D 17/04* (2006.01)
*F25D 11/02* (2006.01)

(52) U.S. Cl.
USPC ..... 62/187; 62/407; 62/441

(58) Field of Classification Search
USPC ..... 62/186, 187, 441, 447, 404, 407, 408; 454/265, 274, 324, 334, 348, 362
See application file for complete search history.

(56) References Cited

U.S. PATENT DOCUMENTS

| | | | | | |
|---|---|---|---|---|---|
| 3,248,893 | A | * | 5/1966 | McLean | 62/156 |
| 4,688,393 | A | * | 8/1987 | Linstromberg et al. | 62/187 |
| 5,097,675 | A | * | 3/1992 | Elsom et al. | 62/408 |
| 5,490,395 | A | * | 2/1996 | Williams et al. | 62/187 |
| 5,642,628 | A | * | 7/1997 | Whipple et al. | 62/186 |
| 5,711,159 | A | * | 1/1998 | Whipple, III | 62/82 |
| 6,032,480 | A | * | 3/2000 | Kim | 62/408 |

* cited by examiner

*Primary Examiner* — Allana Lewin
*Assistant Examiner* — Travis Ruby

(57) ABSTRACT

A refrigerator, including a cabinet having top, bottom, rear and opposing side walls that collectively define a freezer compartment and a fresh food compartment, employs a cooling system and an air plenum to deliver a cooling air flow into the freezer and fresh food compartments. The air plenum includes a variable position air damper having a first, substantially straight portion and a second arcuate portion that forms an air scoop. The air damper is slidably mounted within the air plenum between first and second positions. The variable position air damper is selectively arranged in the first position to efficiently deliver a volume of the cooling air flow into the freezer compartment, the second position to deliver the cooling airflow into the fresh food compartment or in an infinite number of intermediate positions to deliver the cooling airflow into both compartments.

15 Claims, 4 Drawing Sheets

VARIABLE POSITION AIR DAMPER FOR A REFRIGERATOR

CROSS-REFERENCE TO RELATED APPLICATIONS

This application represents a divisional application of U.S. application Ser. No. 11/780,179, filed Jul. 19, 2007.

BACKGROUND OF THE INVENTION

1. Field of the Invention

The present invention pertains to the art of refrigerators and, more particularly, to a variable position damper that can be selectively controlled to deliver cooling air into a freezer compartment and/or a fresh food compartment of a refrigerator.

2. Description of the Related Art

There are many systems for delivering cooling air into refrigerator compartments to maintain selected temperatures. In some cases, the refrigerator is provided with two cooling systems, one system delivering cooling air into the freezer compartment and another, separate system, delivering cooling air into the fresh food compartment. While effective, the manufacturing costs associated such refrigerators are high. Moreover, operating multiple cooling systems reduces an overall efficiency of the appliance.

In other cases, cooling air is first delivered into the freezer compartment to establish a freezer compartment temperature. With this arrangement, cool air is directed from the freezer compartment into the fresh food compartment to establish and/or maintain a desired fresh food compartment temperature. Typically, the cool air is guided through a passage that interconnects the freezer and fresh food compartments. A damper is typically arranged within the passage to selectively allow cooling air to pass into the fresh food compartment when necessary, and close off the passage absent a need for cooling air. Efficiency gains were realized with the use of variable position dampers that control how much cooling air is passed into the fresh food compartment. Additional efficiencies were realized with the use of variable capacity compressors and variable speed fans. As a demand for cooling is sensed, instead of operating at maximum output, the compressor and fans are driven at a speed sufficient to satisfy a particular cooling demand.

Unfortunately, the energy savings realized in known systems that employ dampers is limited. Usually, most of the cooling demand is required in the freezer compartment. In situations where the fresh food compartment requires a small adjustment, the cooling system needs to overdrive the freezer compartment in order to have sufficient cooling air to siphon off to the fresh food compartment. In some cases, a demand for cooling in the fresh food compartment is not met until the freezer compartment also requires cooling. In order to address this problem, some manufacturers position the damper between the cooling system and both the freezer and fresh food compartments. In this configuration, the damper is positioned to deliver cooling air into one or the other compartment depending on a particular cooling demand.

In one such arrangement, the damper is positioned at an opening in a side wall of an air plenum. The damper is shifted to allow cooling air into one, the other or both of the freezer and fresh food compartments. While effective, the particular geometry of the damper leads to inefficient air transfer. Back pressure, created by turbulences in the air flow, impedes delivery of cooling air into one or the other compartment. When the damper is positioned to allow air to pass into both compartments, the back pressure results in the volume of air flowing into each compartment to be unregulated.

Based on the above, despite the existence of refrigerator air delivery systems in the prior art, there still exists a need for a refrigerator air delivery system that employs a variable position damper to deliver air to multiple refrigerated compartments either individually or simultaneously. Moreover, there exists a need for a variable position damper that includes an air scoop to reduce air turbulence and efficiently deliver cooling air into freezer and/or fresh food compartments.

SUMMARY OF THE INVENTION

The present invention is directed to a refrigerator including a cabinet having top, bottom, rear and opposing side walls that collectively define a freezer compartment and a fresh food compartment and, more particularly, to a cooling system that develops and delivers a cooling air flow into the freezer and fresh food compartments. The cooling air flow is guided through an air plenum that interconnects the cooling system with the freezer compartment and the fresh food compartment. In accordance with the invention, a variable position air damper is slidably mounted within the air plenum. The variable position air damper includes a first, substantially straight portion which leads to an arcuate portion that forms an air scoop. The air damper is selectively positioned to deliver the cooling air flow into the fresh food and/or freezer compartments, with the air scoop minimizing air flow turbulences, thereby creating efficiencies in the air flow.

In further accordance with the invention, the refrigerator includes a drive motor that selectively positions the damper to deliver the cooling air flow into the freezer and/or fresh food compartments. Operation of the drive motor is established by a control unit. The control unit is linked to temperature sensors located in the freezer and fresh food compartments. Upon receipt of a signal from a temperature sensor, the control unit selectively activates the drive motor to establish a position of the air damper to satisfy a sensed cooling need.

In accordance with one embodiment of the invention, the air damper slides between a first position, wherein cooling air is diverted into the freezer compartment, and a second position, wherein cooling air is directed into the fresh food compartment. The air damper can be selectively arranged in an infinite number of intermediate positions to deliver cooling air into both the freezer and fresh food compartments. Preferably, at least a portion of the air damper is formed from a flexible material that facilitates transition between the first and second positions.

In accordance with another embodiment of the present invention, the air damper slides along a longitudinal axis of the air plenum. More specifically, the air damper slides along a guide track positioned within the air plenum. With this arrangement, the air damper can be selectively positioned in a first position, wherein all of the cooling air passes to the freezer compartment, and a second position wherein all of the cooling air passes to the fresh food compartment. As with the first embodiment, the air damper can be placed in an infinite number of intermediate positions to control a volume of cooling air being delivered to each of the freezer and fresh food compartments, with the air scoop advantageously reducing air flow turbulence to increase air flow efficiency.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
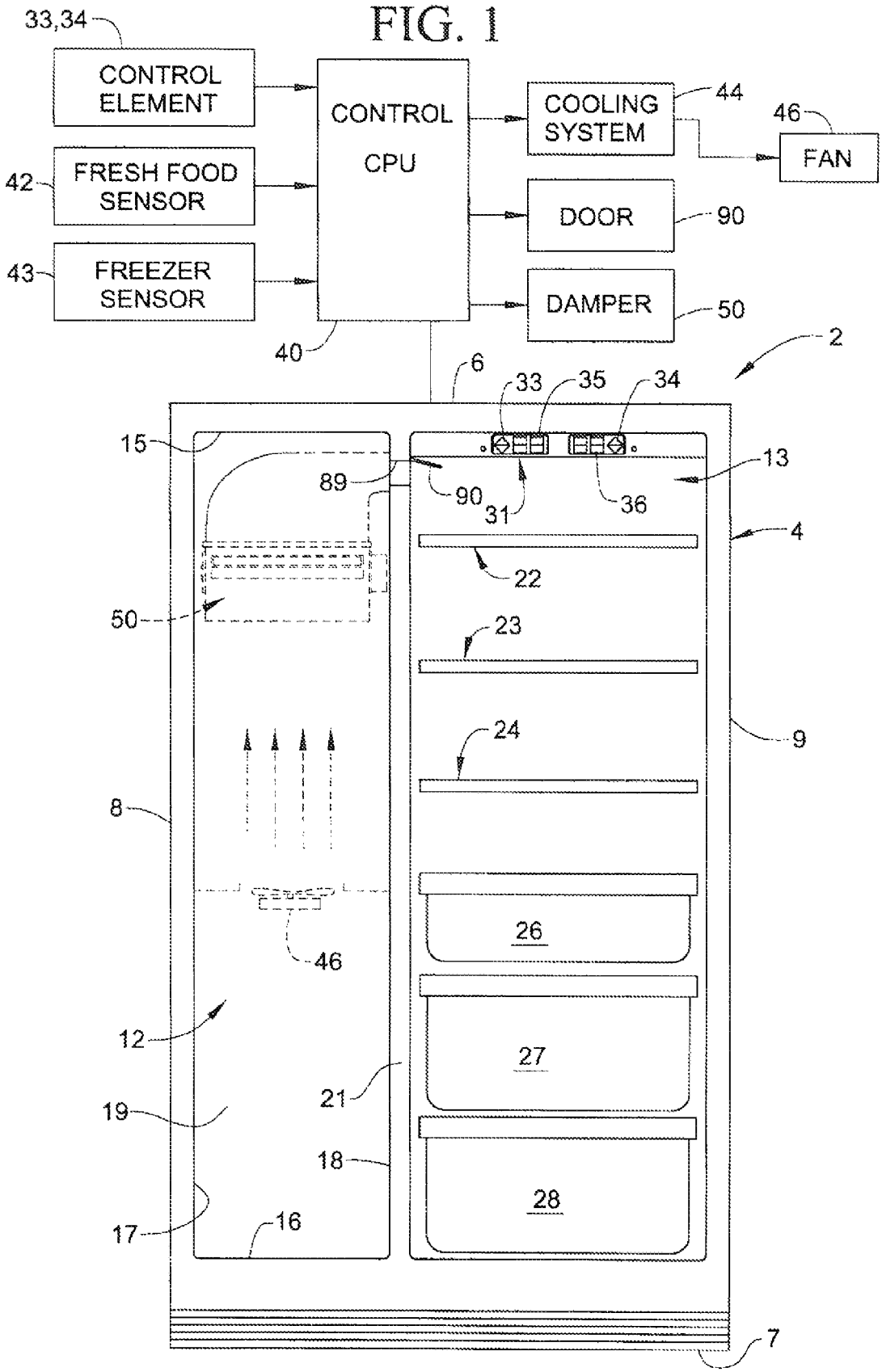
FIG. 1 is a front, elevational view of a side-by-side refrigerator incorporating a variable position air damper constructed in accordance with a first embodiment of the present invention.

With initial reference to FIG. 1, a refrigerator, generally indicated at 2, is shown to include a cabinet 4 having a top wall 6, a bottom wall 7 and opposing side walls 8 and 9 that collectively define a freezer compartment 12 and a fresh food compartment 13. Freezer compartment 12 includes top, bottom and opposing side walls 15-18, with side wall 18 forming part of a mullion 21 which separates freezer compartment 12 from fresh food compartment 13. In the embodiment shown, refrigerator 2 actually constitutes a side-by-side model. However, it should be understood that the present invention can be employed in various types of refrigerators, including top mount, bottom mount and French door style models. In any case, fresh food compartment 13 is shown to include a plurality of shelves 22-24 used to support various food items, as well as a plurality of storage bins 26-28 for storing items such as vegetables, meat and dairy products. Freezer compartment 12 can also include shelves, bins and the like which have been omitted for the sake of clarity in the drawings.

In a manner known in the art, refrigerator 2 includes a control panel 31 which enables a consumer to set desired temperatures for freezer compartment 12 and fresh food compartment 13. Towards that end, control panel 31 includes a plurality of control elements 33 and 34 each being associated with a corresponding display 35 and 36. As illustrated, control panel 31 is operatively connected to a control 40. Control 40, in a manner also known in the art, receives inputs from the plurality of control elements 33 and 34, as well as temperature sensors 42 and 43 located within freezer compartment 12 and fresh food compartment 13 respectively, to establish the need for cooling. More specifically, upon sensing a need for cooling, control 40 activates a cooling system 44 having at least a fan 46 that directs a cooling air flow into freezer compartment 12 and/or fresh food compartment 13 to establish and maintain the selected temperatures. In accordance with the invention, cooling air is directed along rear wall 19 of freezer compartment 12 through a variable position air damper system 50 and into freezer compartment 12 and/or fresh food compartment 13 as will be discussed more fully below.

Figure 2:
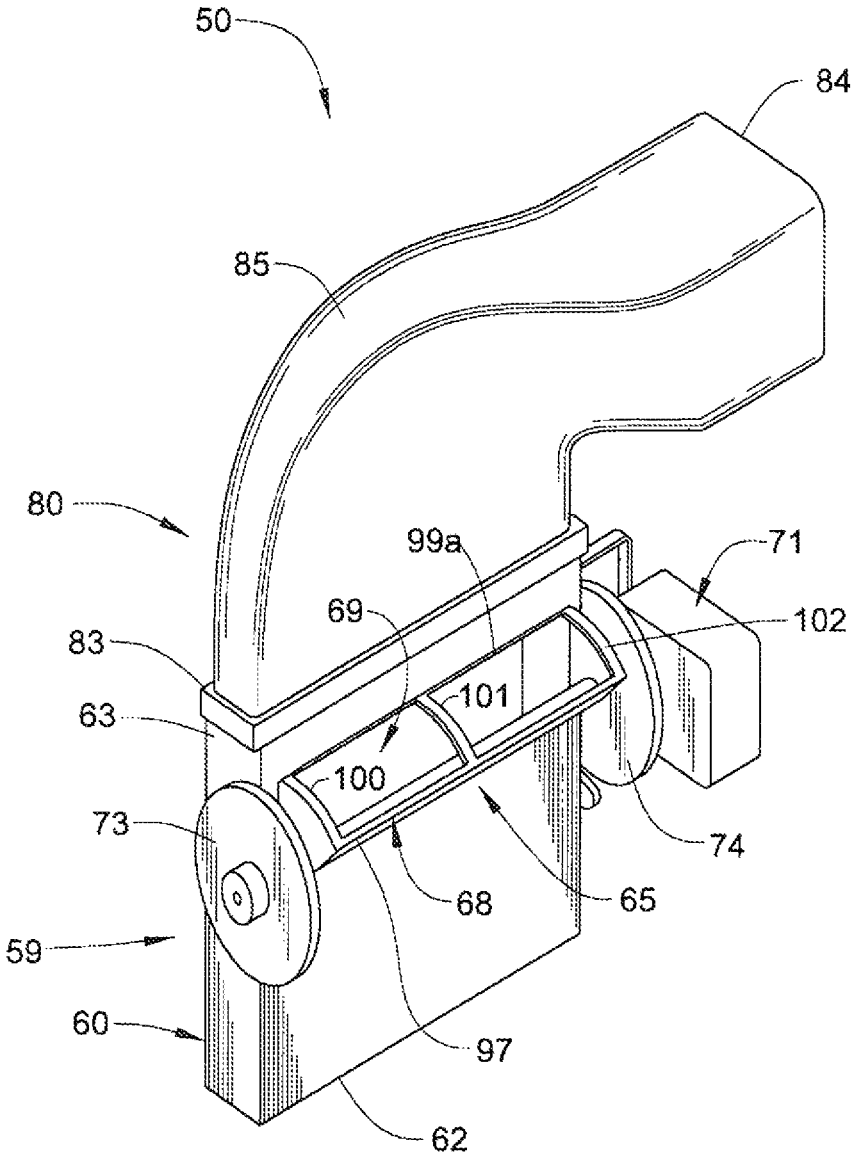
FIG. 2 is an upper left perspective view of the variable position air damper system of FIG. 1.
Figure 4:
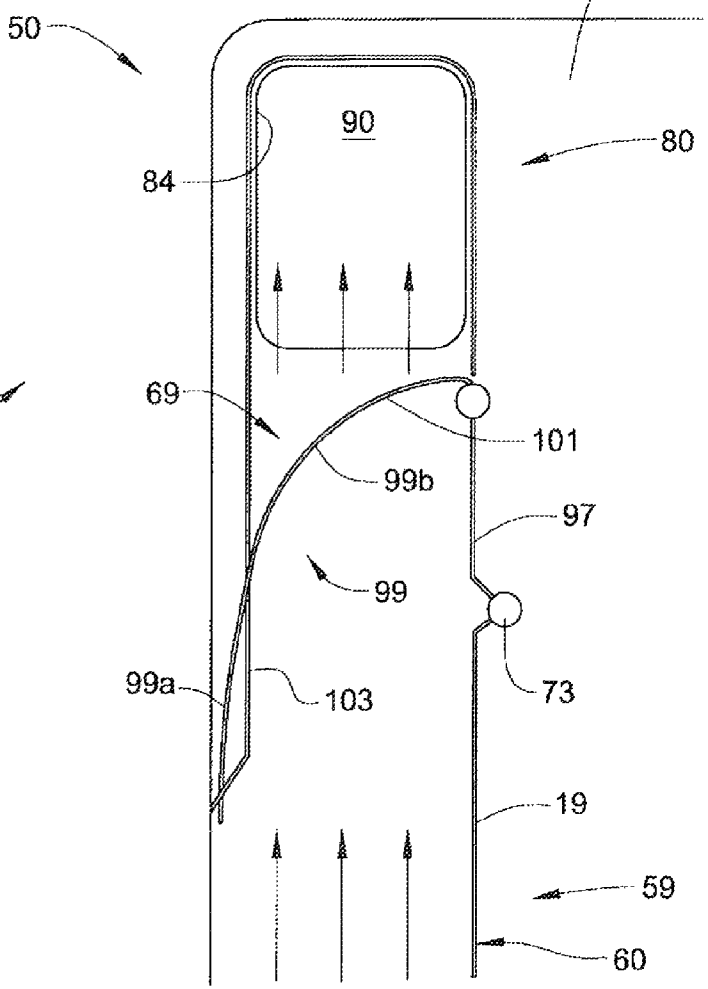
FIG. 4 is a variable position air damper system of FIG. 1 shown in a second position wherein cooling air flows into a fresh food compartment of the refrigerator.
Figure 3:
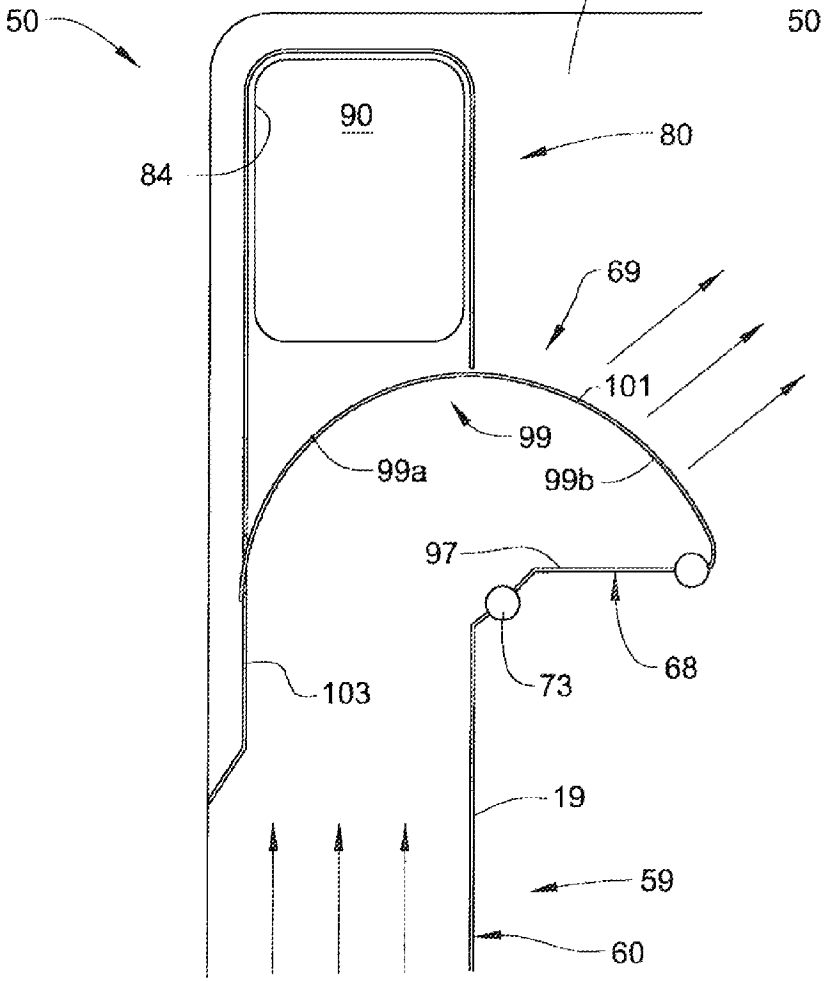
FIG. 3 is a schematic view illustrating the variable position air damper system of FIG. 1 in a first position wherein cooling air flows into a freezer compartment of the refrigerator.

As best shown in FIG. 2 which illustrates a first embodiment of the present invention, variable position air damper assembly 50 includes an air plenum 59 having a main body portion 60 including an inlet section 62, an outlet section 63 and a damper portion 65. As shown, damper portion 65 includes a variable position damper 68 that is arcuately, slidably mounted within air plenum 59. Damper 68 is provided with an outlet 69 that selectively delivers cooling air into freezer compartment 12 and/or fresh food compartment 13. Towards that end, damper 68 is operatively connected to a drive motor 71. Drive motor 71 is selectively operated by control 40 to slide damper 68 between a first position shown in FIG. 3, wherein cooling air flows only into freezer compartment 12, and a second position shown in FIG. 4, wherein cooling air flows only into fresh food compartment 13. Depending on a demand for cooling, as signaled by sensors 42 and 43, control 40 can selectively operate drive motor 71 to orient damper 68 in an infinite number of intermediate positions to allow a desired volume of cooling air to pass into both freezer compartment 12 and fresh food compartment 13. The particular position of damper 68 is determined by the volume of cooling air necessary to establish the selected temperature for freezer compartment 12 and/or fresh food compartment 13. The greater the need or demand for cooling, the larger the volume of cooling air is passed into a particular compartment. In any event, drive motor 71 slides damper 68 about an axis defined by first and second wheels 73 and 74.

In accordance with the embodiment shown in FIG. 2, air flowing from inlet section 62 exits air plenum 59 and either passes into freezer compartment 12 or flows upward through outlet section 63 into a fresh food air plenum 80. As shown, fresh food air plenum 80 includes an inlet portion 83, an outlet portion 84 and a curving intermediate portion 85. Outlet portion 84 preferably registers with a channel or passage 89 that interconnects freezer compartment 12 and fresh food compartment 13. Passage 89 is provided with a one-way flapper valve or door 90 that is selectively positioned to control a flow of cooling air passing from fresh food air plenum 80 through passage 89. Door 90, although not a required component, advantageously prevents reverse moisture migration from fresh food compartment 13 to freezer compartment 12.

In further accordance with the embodiment shown, damper 68 includes a first or substantially straight portion 97 that leads to a second or arcuate portion 99 including a solid portion 99*a* and an open portion 99*b* that is established by a plurality of strips 100-102 which collectively define outlet 69 that opens upward to create a preferential air flow which circulates about freezer compartment 12. In the most preferred form of the invention, damper 68 is formed from a flexible material that allows damper 68 to readily transition between the first and second positions. More specifically, when damper 68 transitions from the first position to the second position, arcuate portion 99 slides along a rear wall 103 of air plenum 59. By forming arcuate portion 99 from a flexible material, this transition is smooth, reliable and repeatable. In addition, arcuate portion 99 includes a concave surface (not separately labeled) that defines an air scoop. The air scoop enhances flow characteristics of the cooling air passing over damper 68. More specifically, the air scoop minimizes turbulence in the cooling air flow such that the airflow is channeled or smoothed, i.e., substantially laminar. By ensuring that the cooling air flow is channeled or smoothed, any back pressure caused by turbulence(s) in the air flow which could inhibit or reduce the air flow passing into freezer compartment 12 is virtually eliminated.

Figure 5:
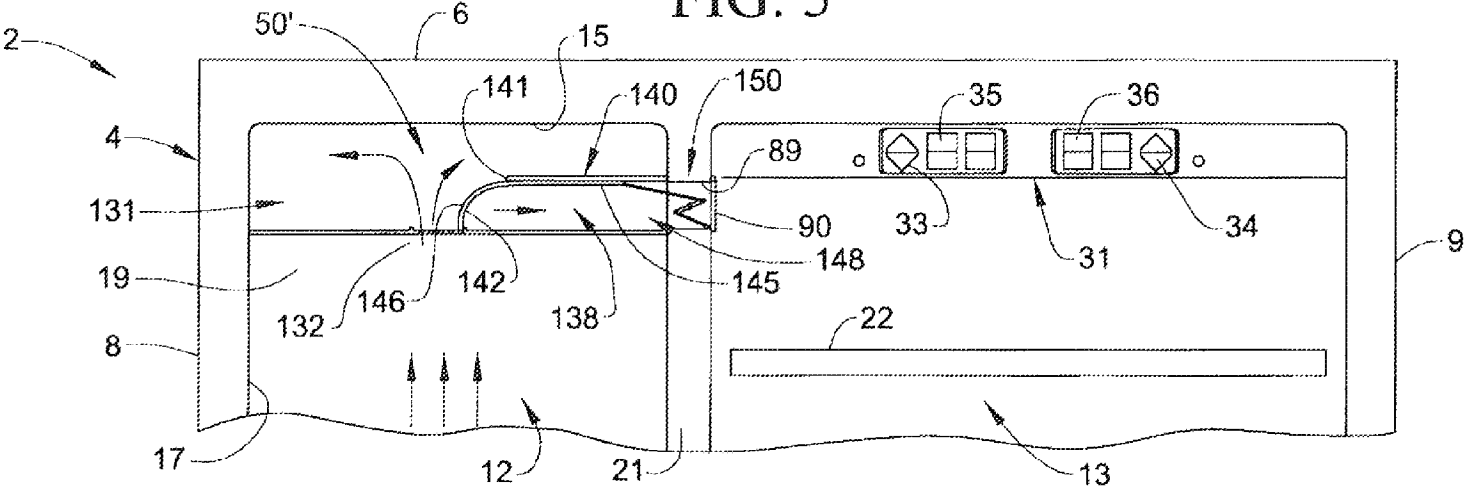
FIG. 5 is a partial, plan view of a side-by-side refrigerator incorporating a variable position air damper system constructed in accordance with a second embodiment of the present invention shown in a first position allowing all the cooling air to flow to into the freezer compartment.
Figure 6:
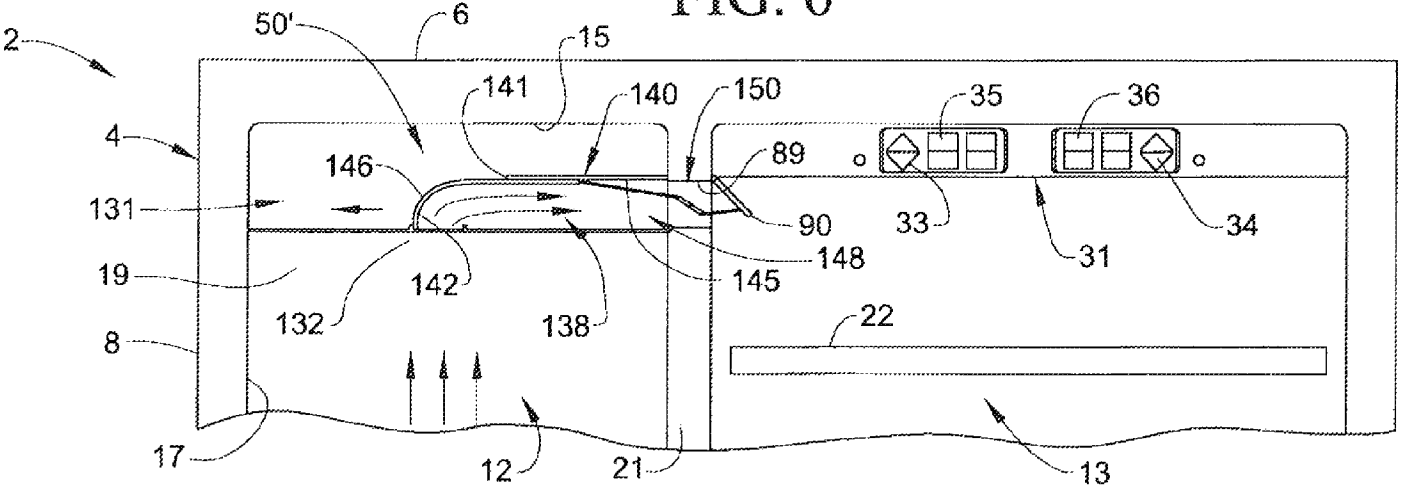
FIG. 6 is a partial front elevational view of the refrigerator of FIG. 5 with the variable position air damper system of FIG. 5 in a second position allowing all the cooling air to flow into the fresh food compartment of the refrigerator.

Reference will now be made to FIGS. 5 and 6, where like reference numbers represent corresponding parts in their respective views, in describing a variable position air damper assembly 50' constructed in accordance with a second embodiment of the present invention. Air damper assembly 50' is arranged within an air plenum 131 that is located in an upper rear portion of freezer compartment 12. Air plenum 131 includes an inlet opening 132 that enables cooling air to pass from cooling system 44 into freezer compartment 12 and/or fresh food compartment 13. While opening 132 is shown in a central portion of air plenum 131, it should be readily understood that the particular location and size of opening 132 can vary in accordance with the invention. More specifically, air damper assembly 50' includes a linear sliding damper member 138 arranged within air plenum 131. Sliding damper 138 includes a first or static portion 140 that defines a guide track 141 and a second or sliding portion 142 that selectively exposes inlet opening 132 as will be discussed more fully below.

As shown, sliding portion 142 includes a substantially first or straight section 145 that interengages with guide track 141 and a second or arcuate portion 146 that collectively defines, together with static portion 140, a fresh food air plenum 148. In a manner similar to that described above, arcuate section 146 includes a concave surface that defines an air scoop which advantageously enhances flow characteristics of the cooling air flow passing over damper member 138. In accordance with the invention, damper 138 is operated by an automatic, preferably temperature-based control motor (not shown). The motor could take on various forms, such as a solenoid, a wax motor, DC electric motor, or the like. In accordance with another aspect of the invention, damper 138 is driven by a linkage 150 interconnecting door 90 and sliding portion 142. Of course, if so desired, damper 138 could also be constructed so as to be manually operated.

In accordance with the embodiment shown, control 40, upon sensing a demand for cooling in either freezer compartment 12 or fresh food compartment 13, activates cooling system 44 to develop a cooling air flow. Depending upon the compartment(s) requiring cooling, sliding damper 138 is selectively positioned relative to inlet opening 132. If the demand for cooling is solely in freezer compartment 12, sliding damper 138 is arranged in a first position shown in FIG. 5, wherein the entire flow of cooling air is allowed to pass into freezer compartment 12. In contrast, if the cooling demand lies only in fresh food compartment 13, sliding damper 138 is shifted to a second position, such as shown in FIG. 6, allowing all the entire flow of cooling air to pass through fresh food air plenum 148 and into fresh food compartment 13. Of course, it should be understood that the present invention can also selectively position sliding damper member 138 in an infinite number of intermediate positions to control the percentage of air passing to both freezer compartment 12 and fresh food compartment 13. By regulating the exposure of inlet opening 132, the volume of air passing into each compartment 12, 13 can be selectively controlled in order to tailor an amount of air flow to satisfy any cooling demand in the compartments.

As indicated above, in addition to tailoring the air flow of cooling air into each compartment, the present invention advantageously employs curved or curvilinear surfaces that channel or smooth the airflow in order to minimize turbulence. By ensuring that the air flow is channeled or smoothed, air flow characteristics are greatly improved, e.g., any back pressure that would result from the creation of turbulences in the air flow is negated. In this manner, the present invention ensures that the desired volume of cooling air is passed into freezer compartment 12 and/or fresh food compartment 13. In addition to the efficiencies created by the present invention, additional components, such as variable speed compressors, variable speed fans and the like, can also be employed to provide further efficiency gains for refrigerator 2.

Although described with reference to preferred embodiments of the invention, it should be readily understood that various changes and/or modifications can be made to the invention without departing from the spirit thereof. For instance, while each variable position damper is shown to include a single outlet, a bifurcated outlet can also be employed to direct air flow into various portions of the fresh food compartment in order to avoid temperature stratification. In addition, open portion **99*b*** could be formed by a plurality of openings or perforations. In general, the invention is only intended to be limited by the scope of the following claims.

What is claimed is:

1. A refrigerator comprising:

a cabinet having top, bottom, and opposing side walls that collectively define a freezer compartment and a fresh food compartment;

a cooling system for developing and delivering a cooling air flow for the freezer and fresh food compartments;

an air plenum interconnecting the cooling system, freezer compartment and fresh food compartment;

a fresh food plenum including an inlet portion, an outlet portion and an intermediate portion, said outlet portion leading to the fresh food compartment; and an air damper slidably mounted for linear movement within the air plenum, said air damper including an arcuate portion defining an air scoop, said air scoop constituting the inlet portion of the fresh food plenum and being slidably re-positionable to selectively: enable the cooling air flow into the freezer compartment while blocking the cooling air flow from entering the fresh food plenum and the fresh food compartment in a first position; block the cooling air flow from entering the freezer compartment while redirecting the cooling air flow along the air scoop and into the fresh food compartment in a second position; and enable the cooling air flow to be delivered into both the freezer compartment and the fresh food compartment in at least one position between the first and second positions.

2. The refrigerator according to claim 1, further comprising: a drive motor, said drive motor being operated to position the air damper.

3. The refrigerator according to claim 2, further comprising:

a freezer compartment temperature sensor;

a fresh food compartment temperature sensor;

a plurality of control elements for selecting a desired temperature in each of the freezer and fresh food compartments; and a control unit operatively connected to the freezer compartment temperature sensor, the fresh food compartment temperature sensor, the plurality of control elements and the drive motor, said control unit activating the drive motor to selectively position the air damper based on a sensed cooling need in each of the freezer and fresh food compartments.

4. The refrigerator according to claim 1, wherein the air plenum includes an inlet portion, an outlet portion and a damper portion located between the inlet portion and the outlet portion, said air damper being arranged in the damper portion of the air plenum.

5. The refrigerator according to claim 1, wherein the air damper includes a static portion and a sliding portion that collectively define the fresh food plenum.

6. The refrigerator according to claim 5, wherein the static portion includes a guide track, said sliding portion being selectively shifted along the guide track.

7. The refrigerator according to claim 1, further comprising: a door pivotally mounted at a passage disposed between the freezer and fresh food compartments to selectively enable cold air to pass from the freezer compartment to the fresh food compartment, said arcuate portion of the air damper being operatively connected to the door through a linkage.

8. A method of delivering a cooling air flow from a cooling system to one or both of a freezer compartment and a fresh food compartment in a refrigerator comprising:

sensing a need for cooling in at least one of the freezer and fresh food compartments;

activating a cooling system to generate a cooling air flow;

selectively re-positioning an air damper, including an arcuate portion forming an air scoop at an inlet thereof, along a linear path in an air plenum interconnecting the cooling system, the freezer compartment and the fresh food compartment;

guiding the cooling air flow based on the sensed need for cooling into one of the group consisting of: the freezer compartment, while blocking the cooling air flow from being redirected by the air scoop into the fresh food compartment; the fresh food compartment, while blocking the cooling air flow into the freezer compartment; and both the freezer and fresh food compartments.

9. The method according to claim 8, further comprising: activating a drive motor to slide the air damper between a first position wherein cooling air is directed into the freezer compartment, a second position wherein cooling air is directed into the fresh food compartment, and a plurality of intermediate positions wherein cooling air is directed into both the freezer and fresh food compartments.

10. The method according to claim 8, wherein the air damper is re-positioned through a linkage connected to a door pivotally mounted at a passage between the freezer and fresh food compartments.

11. The method according to claim 10, wherein the air damper slides along the linear path in unison with the pivoting of the door.

12. The method according to claim 8, wherein the air damper is manually re-positioned.

13. The refrigerator according to claim 1, wherein the cooling air flow leaves the cooling system, travels though the air plenum, and is then selectively delivered by the air damper.

14. The method according to claim 8, wherein guiding the cooling air flow occurs after the cooling airflow leaves the cooling system and travels through the air plenum, and prior to entering any of the freezer compartment, the fresh food compartment, or both the freezer and fresh food compartments.

15. A refrigerator comprising:

a cabinet having top, bottom, and opposing side walls that collectively define a freezer compartment and a fresh food compartment;

a cooling system for developing and delivering a cooling air flow for the freezer and fresh food compartments;

an air plenum interconnecting the cooling system, freezer compartment and fresh food compartment; and an air damper slidably mounted for linear movement within the air plenum, said air damper including an inlet at a first end thereof, an outlet at a second end thereof and an arcuate portion defining an air scoop, the air scoop being located at the first end and slidably re-positionable from a first state in which the air scoop is positioned to enable the cooling air flow to enter the freezer compartment, while preventing the cooling air flow from passing along the scoop into the fresh food compartment, to a second state in which the air scoop is positioned to block the cooling air flow from entering the freezer compartment, while redirecting the cooling air flow along the air scoop and into the fresh food compartment, said air scoop also being slidably re-positionable between the first state and the second state so that the cooling air flow is delivered to both the freezer compartment and the fresh food compartment.

* * * * *